United States Patent [19]

Sasaki

[11] Patent Number: 4,809,572

[45] Date of Patent: Mar. 7, 1989

[54] POWER DRIVEN SCREWDRIVER

[75] Inventor: Katsuhiko Sasaki, Anjo, Japan

[73] Assignee: Makita Electric Works, Ltd., Anjo, Japan

[21] Appl. No.: 128,925

[22] Filed: Dec. 4, 1987

[30] Foreign Application Priority Data

Dec. 9, 1986 [JP] Japan ..... 61-292835

[51] Int. Cl.[4] ..... B25B 23/00

[52] U.S. Cl. ..... 81/429; 81/58.3

[58] Field of Search ..... 81/58.3, 57, 57.11, 81/57.12, 57.13, 57.14, 429, 451

[56] References Cited

U.S. PATENT DOCUMENTS

| | | | |
|---|---|---|---|
| 1,744,976 | 1/1930 | Levedahl | 81/57.14 |
| 2,566,183 | 8/1951 | Forss | 81/57.14 |
| 2,790,471 | 4/1957 | Graybill | 81/429 |
| 3,454,059 | 7/1969 | Sindelar | 81/429 |
| 3,527,273 | 9/1970 | Falter | 81/429 |
| 4,630,512 | 12/1986 | Durr | 81/429 |

FOREIGN PATENT DOCUMENTS 3510605 10/1986 Fed. Rep. of Germany .

*Primary Examiner*—Frederick R. Schmidt

*Assistant Examiner*—Maurina Rachuba

*Attorney, Agent, or Firm*—Dennison, Meserole, Pollack & Scheiner

[57] ABSTRACT

A power driven screwdriver includes a housing, a drive motor mounted within the housing, and a main gear rotatably driven by the drive motor. A spindle is axially movably supported within the housing and has a driver bit secured thereto. The spindle has a groove formed in the rear end thereof. A claw clutch mechanism is provided and is actuated by axial movement of the spindle so as to transmit and disconnect the rotation of the main gear to the spindle. The claw clutch mechanism includes a fixed clutch member formed on the main gear and a movable clutch member mounted on the spindle adjacent the rear end thereof. The movable clutch member has a groove formed in the forward end thereof in opposed relation to the groove of the spindle. One of the grooves of the spindle and the movable clutch member is configured to form an axially inclined groove. Engaging means is interposed between the groove of the spindle and the groove of the movable clutch member. A spring is positioned between the main gear and the movable clutch member and is adapted to normally urge the movable clutch member in a direction away from the fixed clutch member.

11 Claims, 8 Drawing Sheets

POWER DRIVEN SCREWDRIVER

BACKGROUND OF THE INVENTION

1. Field of the Invention

The present invention relates to a power driven screwdriver, and more particularly to a clutch mechanism for such a screwdriver which will transmit rotation from a drive motor to a spindle with a driver bit.

2. Description of the Prior Art

Such power driven screwdrivers may include a drive motor, a main gear rotated by the drive motor, an axially movable spindle having a driver bit secured thereto, and clutch means adapted to transmit and disconnect the rotation from the drive motor to the spindle. Basically, the clutch means includes a claw clutch mechanism which is composed of a fixed clutch member formed on the main gear and a movable clutch member mounted on the spindle and adapted to engage the fixed clutch member. Thus, axial movement of the spindle causes the movable clutch member to move into and out of driving engagement with the fixed clutch member. Such screwdrivers are disclosed, for example, in U.S. Pat. Nos. 2,940,488, 3,527,273 and 3,712,352.

In such screwdrivers using a simple claw clutch mechanism, however, the rotation of the spindle is restrained at the completion of a screw driving operation, thereby causing the clutch mechanism to temporarily repeat its engaging and disengaging operation. This will generate clanging sounds, giving unpleasant feeling to the operator, and cause early wear of the clutch mechanism.

SUMMARY OF THE INVENTION

It is, accordingly, an object of the present invention to provide a power driven screwdriver having a clutch mechanism which may be smoothly disengaged at the completion of a screw driving operation so as to avoid unpleasant clanging sounds.

It is another object of the present invention to provide a power driven screwdriver which will improve efficiency of driving operation and enhance long life of the clutch mechanism.

The power driven screwdriver includes, according to the present invention, a housing, a drive motor mounted within the housing, and a main gear rotatably driven by the drive motor. A stopper sleeve is attached to the forward end of the housing. A spindle is axially movably supported within the housing and has a driver bit disposed within the stopper sleeve. The spindle has a groove formed in the rear end thereof. A claw clutch mechanism is provided and is actuated by axial movement of the spindle so as to transmit and disconnect the rotation of the main gear to the spindle. The claw clutch mechanism includes a fixed clutch member formed on the main gear and a movable clutch member mounted on the rear end of the spindle so as to engage the fixed clutch member. The movable clutch member has a groove formed in the forward end thereof in opposed relation to the groove of the spindle. At least one of the grooves of the spindle and the movable clutch member is configured to form an axially inclined groove. Engaging means is interposed between the groove of the spindle and the groove of the movable clutch member. A spring is positioned between the main gear and the movable clutch member and is adapted to normally urge the movable clutch member in a direction away from the fixed clutch member.

Thus, when the driver bit held by the spindle is pressed against a work surface, the spindle is pushed rearwardly in the axial direction and thence the engaging means is moved in the inclined groove of the spindle or the movable clutch member. As this occurs, the movable clutch member is moved toward the fixed clutch member against the biasing force of the spring, until the movable clutch member engages the fixed clutch member. Rotation from the drive motor is then transmitted to the spindle. When the stopper sleeve attached to the housing engages the work surface, the spindle and the movable clutch member are pushed forwardly by the amount corresponding to the height of teeth of the fixed clutch member, so that the movable clutch member is disengaged from the fixed clutch member, terminating the transmission of rotation. Simultaneously therewith, the biasing force of the spring causes the movable clutch member to be completely disengaged from the fixed clutch member through the shifting movement of the engaging means along the inclined groove.

The present invention will become more fully apparent from the claim and the description as it proceeds in connection with the drawings.

DETAILED DESCRIPTION OF THE PREFERRED EMBODIMENTS

Figure 1:
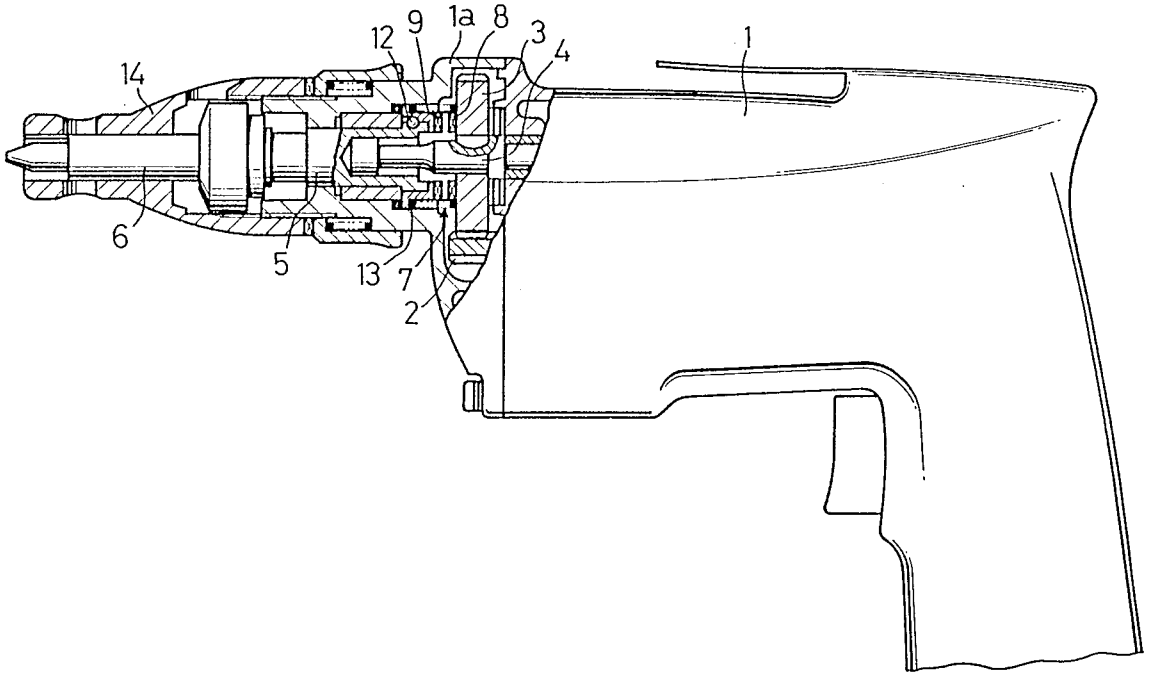
FIG. 1 is a side view, partially in section, of a power driven screwdriver according to a first embodiment of the present invention.

Referring now to FIGS. 1 to 4, shown therein is a power driven screwdriver according to a first embodiment of the present invention. As shown therein, the screwdriver includes a housing 1 having a cylindrical portion 1*a*. The housing 1 contains a drive motor (not shown) having a shaft on which a gear 2 is formed. The gear 2 drivingly engages a main gear 3 fixed to a support shaft 4. A spindle 5 is rotatably and axially movably supported within the cylindrical portion 1*a* of the housing 1 in coaxial relation to the support shaft 4. The forward end of the spindle 5 has a driver bit 6 secured thereto, and the rear end of the spindle 5 is located in spaced apart opposed relation to the main gear 3.

A claw clutch mechanism 7 is provided between the main gear 3 and the spindle 5 and is comprised of a fixed clutch member 8 and a movable clutch member 9. The fixed clutch member 8 is formed on the forward surface of the main gear 3. The movable clutch member 9 is of generally ring-shaped configuration and is fitted coaxially on the spindle 5 adjacent the rear end thereof so as to engage the fixed clutch member 8.

Figure 2:
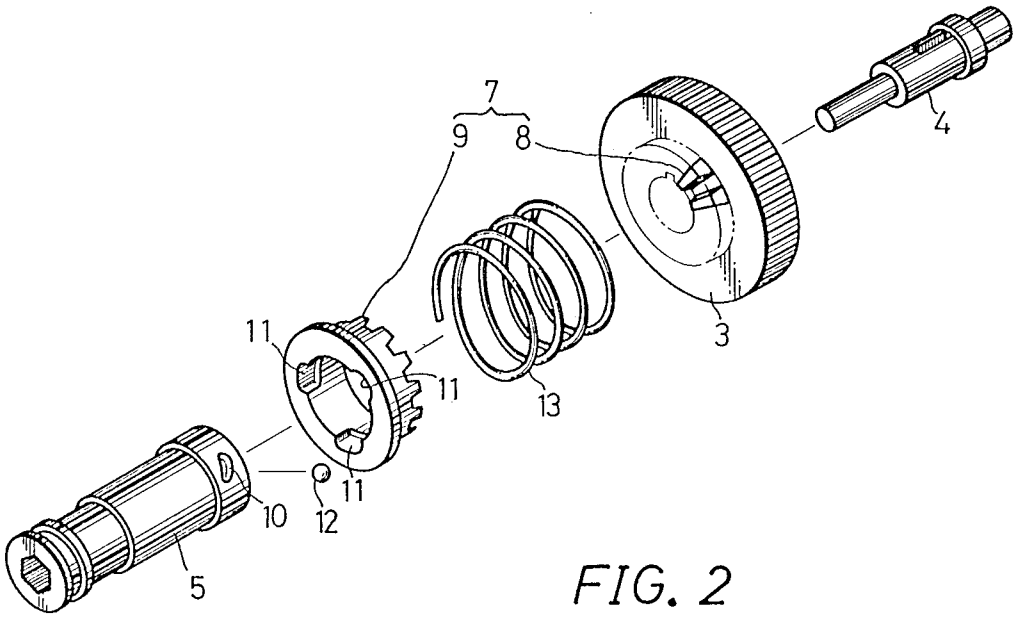
FIG. 2 is an exploded perspective view of the essential parts of the screwdriver.
Figure 3:
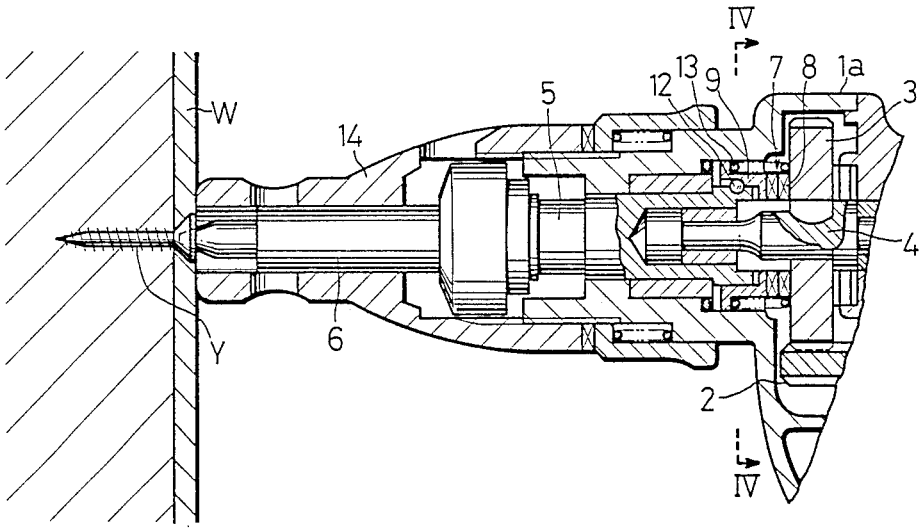
FIG. 3 is an enlarged side sectional view of the essential parts of the screwdriver in its operating position.
Figure 4:
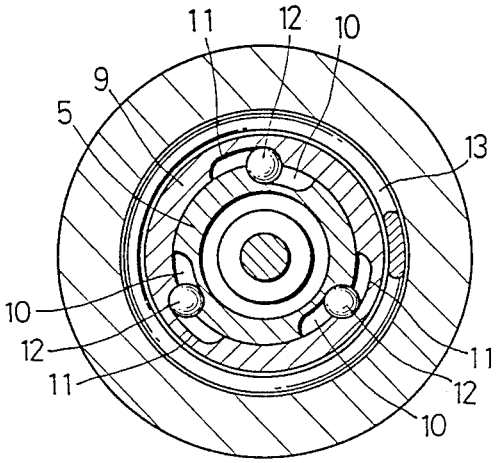
FIG. 4 is an enlarged sectional view taken along the line IV—IV of FIG. 3.

As shown in FIGS. 2 and 4, the spindle 5 has, in the outer periphery of the rear end thereof, three grooves 10 formed at equal intervals and inclined a predetermined extent in the axial direction. The movable clutch member 9 has, in the inner periphery thereof, three engaging grooves 11 each formed in opposed relation to each inclined groove 10 of the spindle 5 and having a forwardly opening end. An engaging ball 12 is received between each pair of opposite grooves 10 and 11.

Thus, the movable clutch member 9 is moved between positions in which it is respectively engaged with and disengaged from the fixed clutch member 8 through axial movement of the spindle 5 and through axial movement of the engaging balls 12 received between the inclined grooves 10 and the engaging grooves 11.

A spring 13 is provided between the main gear 3 and the movable clutch member 9 and is adapted to normally urge the movable clutch member 9 in a direction away from the fixed clutch member 8.

A cylindrical stopper sleeve 14 is threadably secured to the front end of the cylindrical portion 1*a* of the housing 1, retaining the driver bit 6 with its tip projected therefrom. The amount of projection of the tip of the driver bit 6 may be adjusted by changing the axial position of the stopper sleeve 14 relative to the depth to which a screw Y may be driven into a work W.

The operation of the first embodiment thus constructed will now be described with reference to FIGS. 5, 6 and 7A to 7F.

Assuming that the desired predetermined depth adjustment has been made, the tip of the driver bit 6 is applied to the head of the screw Y to be driven, and the screw Y is positioned on the work W.

Figure 5:
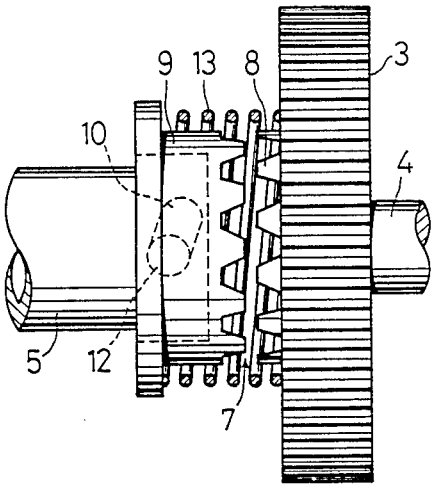
FIG. 5 is a side view of the clutch mechanism in its disengaged position.
Figure 6:
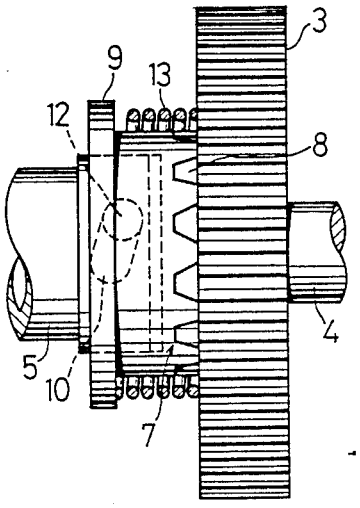
FIG. 6 is a side view of the clutch mechanism in its engaged position.
Figure 7A:
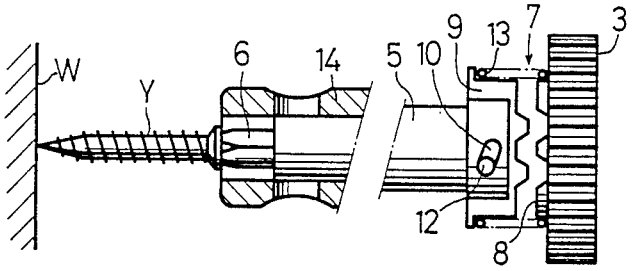
FIGS. 7A to 7F are schematic views illustrating various phases of operation through the screwdriver.

In this position, the engaging balls 12 in the inclined grooves 10 and the engaging grooves 11 are located remote from the main gear 3, or in the lowermost position as viewed in FIG. 5. The movable clutch member 9 is in disengaged position and therefore, when the drive motor is rotated, only the main gear 3 is rotated; rotation of the drive motor is not transmitted to the spindle 5 and the driver bit 6 (FIG. 7A).

Figure 7B:
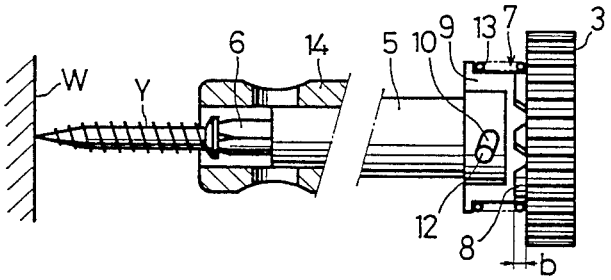

As the operator exerts pressure on the screw Y by pushing forwardly on the tool, the spindle 5 will move rearwardly toward the main gear 3 and thence, the movable clutch member 9 will move against the biasing force of the spring 13 until it engages the fixed clutch member 8. Thereupon, the rotation from the drive motor will be transmitted to the spindle 5 through the main gear 3, causing the driver bit 6 to rotate (FIG. 7B).

Figure 7C:
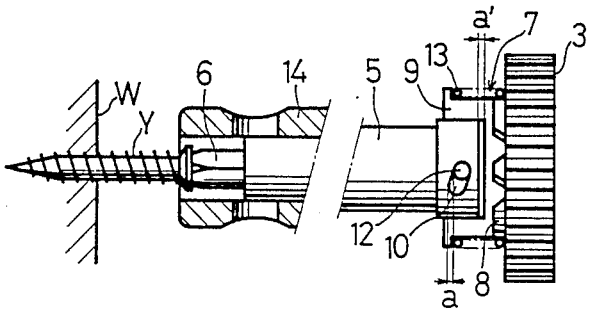

As the screw Y is being driven by the driver bit 6, the movable clutch member 9 will completely engage the fixed clutch member 8. The engaging balls 12 in the inclined grooves 10 and the engaging grooves 11 will be moved to the uppermost position as viewed in FIG. 6. As the result, the spindle 5 will be pushed to the extent of the axial inclination amount a of the inclined grooves 10, providing a clearance a' between the fixed clutch member 8 and the movable clutch member 9 (FIG. 7C).

Figure 7D:
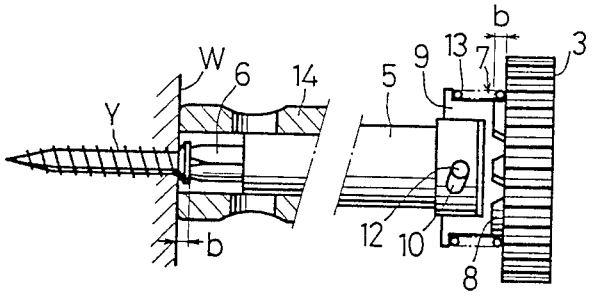

As the screw Y is further driven into the work W, the entire tool will be advanced relative to the work W until such time when the end of the stopper sleeve 14 has engaged the work surface. Thereupon, the spindle 5 and the movable clutch member 9 is pushed forwardly by the amount corresponding to the height b of the teeth of the fixed clutch member 8, causing the driver bit 6 to drive the screw Y to that extent b. The movable clutch member 9 will then be disengaged from the fixed clutch member 8 (FIGS. 7D and 7E).

Figure 7E:
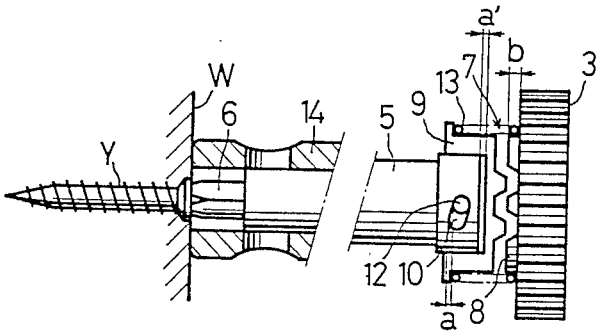
Figure 7F:
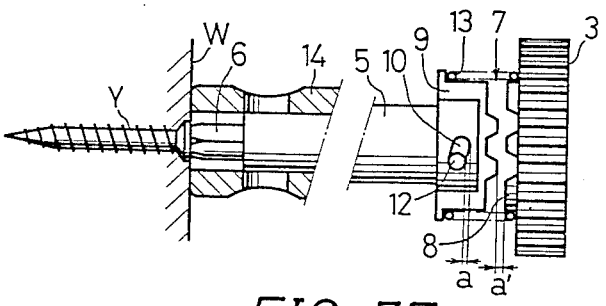

As soon as the movable clutch member 9 is disengaged from the fixed clutch member 8, the engaging balls 12 will moved under the action of the spring 13 along the inclined grooves 10 in a direction away from the main gear 3; and the movable clutch member 9 will be moved by the clearnace a' corresponding to the inclination amount a of the inclined grooves 10, thus providing that clearance a' between the fixed clutch member 8 and the movable clutch member 9.Here, the movable clutch member 9 is completely disengaged from the fixed clutch member 8, disconnecting the rotation from the main gear 3 to the spindle 5 (FIGS. 7E and 7F).

Thus, it can be seen that the disengagement between the fixed clutch member 8 and the movable clutch member 9 may be effected both smoothly and reliably without producing clanging sounds.

Figure 8:
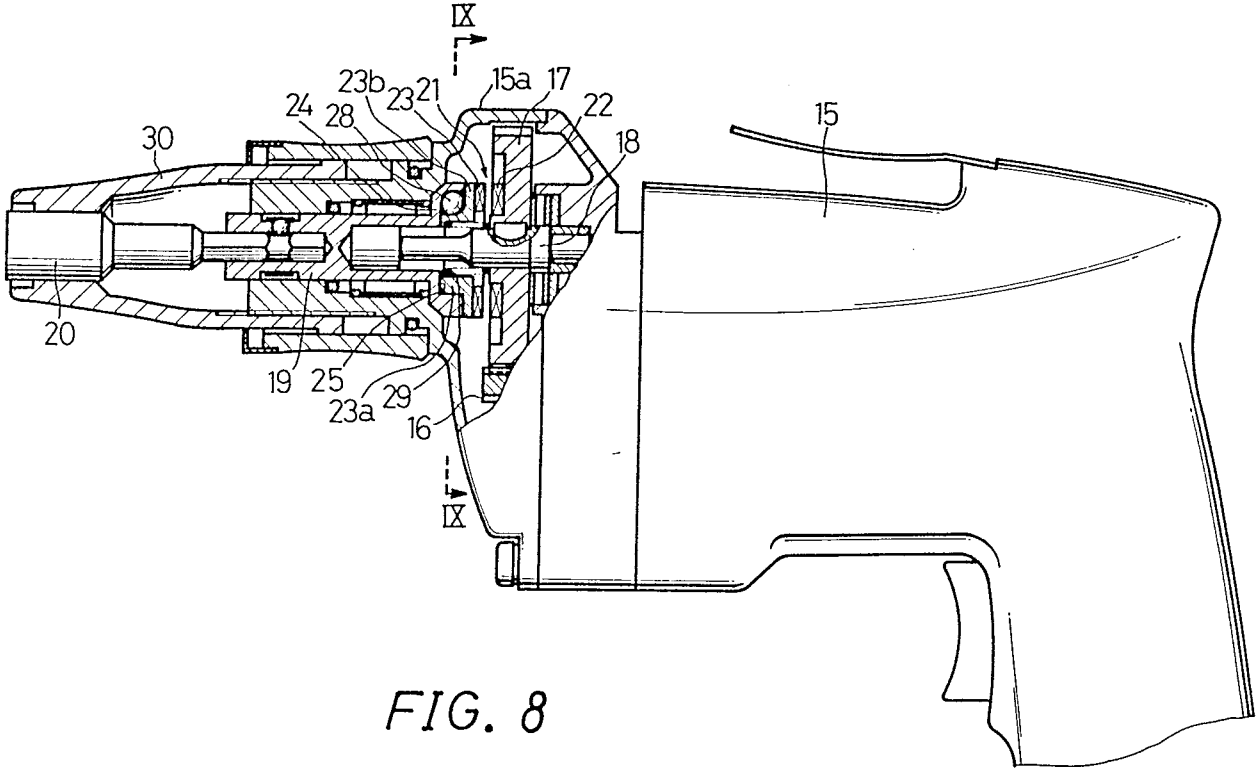
FIG. 8 is a side view, partially in section, of a power driven screwdriver according to a second embodiment of the present invention.
Figure 9:
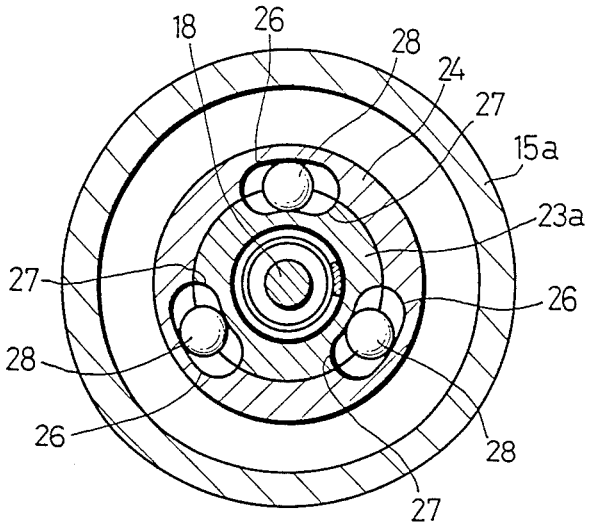
FIG. 9 is an enlarged sectional view taken along the line IX—IX of FIG. 8.
Figure 10:
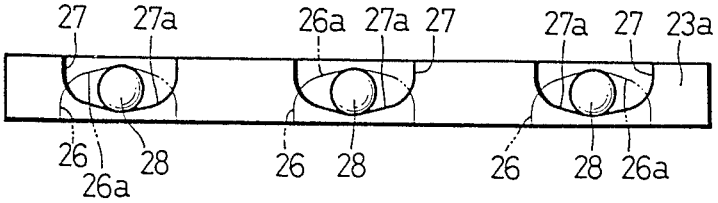
FIG. 10 is a schematic view showing the engaging grooves in developed form.

Referring to FIGS. 8 to 10, shown therein is a second embodiment of the present invention. As in the first embodiment, a power driven screwdriver includes a housing 15 having a cylindrical portion 15*a*. The housing 15 contains a drive motor (not shown) having a shaft on which a gear 16 is formed. The gear 16 drivingly engages a main gear 17 fixed to a support shaft 18. A spindle 19 is rotatably and axially movably supported within the cylindrical portion 15*a* of the housing 15 in coaxial relation to the support shaft 18. The forward end of the spindle 19 has a socket bit 20 secured thereto, and the rear end of the spindle 19 is located in spaced apart opposed relation to the main gear 17.

A claw clutch mechanism 21 is provided between the main gear 17 and the spindle 19 and is comprised of a fixed clutch member 22 and a movable clutch member 23. The fixed clutch member 22 is formed on the forward surface of the main gear 17. The movable clutch member 22 is fitted coaxially in the rear end of the spindle 19 so as to engage the fixed clutch member 23.

The rear end of the spindle 19 has a flange 24 formed integrally therewith. The flange 24 has a circular recess 25 formed in the rear end thereof. As shown in FIG. 9, three, peripherally extending, engaging grooves 26 are cut at equal intervals from the rear end of the flange 24 to the bottom of the recess 25. Each of the engging grooves 26 has, on the bottom thereof, a substantially V-shaped sloping surface 26*a* tapared in a direction axially of the spindle 19, as shown in FIG. 10.

The movable clutch member 23 has a boss 23*a L and a flange 23b* formed integrally therewith. The boss 23*a* is loosely fitted in the recess 25 of the flange 24 of the spindle 19. As shown in FIGS. 9 and 10, the boss 23*a* has, in the outer periphery thereof, three engaging grooves 27 each formed in opposed relation to each engaging groove 26 of the flange 24. As with the engaging grooves 26 of the flange 24, each of the engaging grooves 27 of the boss 23*a* has, on the bottom thereof, a substantially V-shaped sloping face 27*a* tapered in a direction axially of the spindle 19 and symmetric with the sloping surface 26*a* of the flange 24. An engaging ball 28 is received between each pair of opposite grooves 26 and 27.

Thus, the movable clutch member 23 is moved between positions in which it is respectively engaged with and disengaged from the fixed clutch member 22 through axial movement of the spindle 19 and through axial movement of the engaging balls 28 received between the engaging grooves 26 having axially sloping surfaces 26*a* and the engaging grooves 27 having axially sloping surfaces 27*a*.

A spring 29 is provided between the main gear 17 and the movable clutch member 23 and is adapted to normally urge the movable clutch member 23 in a direction away from the fixed clutch member 22.

A cylindrical stopper sleeve 30 is threadably secured to the front end of the cylindrical portion 15*a* of the housing 15, retaining the socket bit 20 with its tip projectted therefrom. The amount of projection of the tip of the socket bit 20 may be adjusted by changing the axial postion of the stopper sleeve 30 relative to the depth to which a screw may be driven into a work.

The operation of the second embodiment is substantially the same as that of the first embodiment, except that the movement of the engaging balls 28 is controlled in the axially sloping surface 26*a* and 27*a* of the engaging grooves 26 and 27, respectively. Thus, the same effect as that of the first embodiment may be attained in the second embodiment.

Although the inclined grooves 10 of the first embodiment are formed on the spindle 5, they may be formed on the movable clutch member 9.

The clutch mechanism of the present invention may be readily adapted to pneumatic screwdrivers. Further, as will be apparent to those skilled in the art, various changes and modifications may be made without departing from the spirit of the present invention which is defined by the appended claims.

What is claimed is:

1. A power driven screwdriver for driving a screw into a work, comprising:

a housing having a forward and a rear end;

a drive motor mounted within said housing;

a fixed clutch member also mounted within said housing and driven by said drive motor;

a spindle rotatably supported within said housing and disposed forwardly of said fixed clutch member, said spindle being axially movable for a predetermined distance;

a stopper sleeve attached to the forward end of said housing;

a driver bit mounted to the forward end of said spindle, said driver bit being inserted into said stopper sleeve such that when the forward end of said stopper sleeve abuts on the work, said driver bit is restrained from moving further toward the work;

a movable clutch member mounted within said housing in opposed relation to said fixed clutch member and engageable with said fixed clutch member;

engaging means for engaging said movable clutch member with said spindle such that said movable clutch member moves a predetermined distance with respect to said spindle in both axial and circumferential directions of said spindle, the axial and circumferential movements of said movable clutch member being correlated such that when said movable clutch member is rotated by said drive motor in one circumferential direction with respect to said spindle, said spindle moves forwardly with respect to said movable clutch member and when said movable clutch member is rotated in the other circumferential direction with respect to said spindle, said movable clutch member moves axially with respect to said spindle in a direction away from said fixed clutch member; and a spring adapted to normally urge said movable clutch member in a direction away from said fixed clutch member;

whereby when said driver bit is pushed onto the screw, said spindle is moved rearwardly to thereby move said movable clutch member rearwardly until the latter engages said fixed clutch member; and whereby when the screw is driven into the work to a predetermined depth, the forward end of said stopper sleeve abuts on the work and said movable clutch member is disengaged from said fixed clutch member, and by reason of the absence of torque between said movable clutch member and said spindle and by reason of the biasing action of said spring, said movable clutch member is moved away from said fixed clutch member until said movable clutch member and said fixed clutch member are brought to their fully non-contacting position.

2. The power driven screwdriver as defined in claim 1 wherein said spindle is formed with a first groove on a surface thereof opposite to said movable clutch member, said movable clutch member is formed with a second groove on a surface thereof in generally opposed relation to said first groove, and an engaging member is interposed between said first and second grooves, and wherein at least one of said first and second grooves extends a predetermined distance in the circumferential direction of said spindle and is configured to smoothly vary the axial position thereof as the circumferential position thereof varies, and the other groove is sized to receive at least a portion of said engaging member therein.

3. The power driven screwdriver as defined in claim 2 wherein said at least one of said first and second grooves is of configuration corresponding substantially to a part of spiral.

4. The power driven screwdriver as defined in claim 2 wherein said other groove extends in a direction axially of said spindle.

5. The power driven screwdriver as defined in claim 2 wherein said first groove is spiral and is formed on an outer periphery of the rear end of said spindle.

6. The power driven screwdriver as defined in claim 2 wherein said spindle is formed with three first grooves spaced substantially equally apart on an outer periphery of said spindle, and wherein said movable clutch member is engaged with said spindle in substantially concentric relation.

7. The power driven screwdriver as defined in claim 2 wherein said engaging member is a ball.

8. The power driven screwdriver as defined in claim 1 wherein said spindle is formed with a first recess on a surface thereof opposite to said movable clutch member, said first recess having a predetermined width and length extending from the rear end to the forward end of said spindle, said movable clutch member is formed with a second recess formed on a surface thereof opposite to said spindle, said second recess having a predetermined width and length extending from the forward end to the rear end of said movable clutch member, and an engaging member is interposed between said first and second recesses, and wherein at least one of said first and second recesses is configured to smoothly vary the length thereof as the transverse position thereof varies, and the other recess is sized to receive at least a portion of said engaging member therein.

9. The power driven screwdriver as defined in claim 8 wherein said first recess is formed on an inner periphery of said spindle, and wherein said second recess is formed on an outer periphery of said movable clutch member.

10. The power driven screwdriver as defined in claim 8 wherein said spindle is formed with three first recess spaced substantially equally apart on an inner periphery thereof, and wherein said movable clutch member is engaged with said spindle in substantially concentric relation.

11. The power driven screwdriver as defined in claim 8 wherein said engaging member is a ball.

* * * * *